US006273579B1

(12) United States Patent
Holloway

(10) Patent No.: US 6,273,579 B1
(45) Date of Patent: Aug. 14, 2001

(54) ILLUMINATED ARTICLE FOR A DOOR HAVING A HANDLE

(76) Inventor: Katie Holloway, 9293 Birwood, Detroit, MI (US) 48204

( * ) Notice: Subject to any disclaimer, the term of this patent is extended or adjusted under 35 U.S.C. 154(b) by 0 days.

(21) Appl. No.: 09/249,356

(22) Filed: Feb. 12, 1999

(51) Int. Cl.[7] ..... E05B 17/10

(52) U.S. Cl. ..... 362/100; 362/253; 362/501; 368/10

(58) Field of Search ..... 362/100, 501, 362/234, 253; 250/466.1; 368/10

(56) References Cited

U.S. PATENT DOCUMENTS

| | | | | |
|---|---|---|---|---|
| 4,041,301 | | 8/1977 | Pelchat . | |
| 4,310,873 | * | 1/1982 | Bean | 362/100 |
| 4,467,402 | | 8/1984 | Bauer et al. . | |
| 4,777,570 | | 10/1988 | Littles | 362/100 |
| 4,779,171 | * | 10/1988 | Ferguson | 362/100 |
| 4,839,989 | | 6/1989 | McConnell . | |
| 4,914,554 | * | 4/1990 | Sowers | 362/100 |
| 5,297,010 | | 3/1994 | Camarota et al. . | |
| 5,581,230 | | 12/1996 | Barrett . | |
| 6,132,057 | * | 10/2000 | Williams | 362/100 |

* cited by examiner

*Primary Examiner*—Stephen Husar
(74) *Attorney, Agent, or Firm*—Gifford, Krass, Groh, Sprinkle, Anderson & Citkowski, P.C.

(57) ABSTRACT

An article is described for providing illumination for a door handle in reduced lighting conditions. The article includes a mounting device and a method for illuminating the door handle. The method for illuminating may comprise a time-keeping device such as a light emitting display digital clock.

10 Claims, 1 Drawing Sheet

ILLUMINATED ARTICLE FOR A DOOR HAVING A HANDLE

BACKGROUND OF THE INVENTION

I. Field of the Invention

The present invention relates generally to an illuminated article for a door having a handle and, more particularly, to an article which may be mounted to a door handle and which has a means for illuminating the handle of the door.

II. Description of the Prior Art

The architectural design of buildings and residences has evolved over the centuries to incorporate the advances in the state of the art of technology. The advances have included all manners of technology from materials to electricity. The integration of the use of electricity in the design of various facilities has brought about a great number of improvements in the quality of life. One area which has not been affected is the problem of locating a door within a darkened room. Low and no light conditions have typically been accommodated by the use of night lights and lights which are timed to come on at specific times of the night. The use of a night light has typically been restricted to the placement of a light at an electrical outlet which is typically somewhere on a wall. A light which comes on at a specific time resolves the problem of location of the door at that specific time but not at other times. These other times are in fact the more likely event to occur.

Industrial and commercial facilities have exit signs which are lighted. These lighted exit signs, however, are usually placed above the door and are usually located in hallways or in common areas of a building. They are not typically located within an individual room such as a hotel room or dormitory room or within a private home. A common problem which occurs is that an individual will wake up during the small hours of the morning and not be able to ascertain the location of the door and, more particularly, where the handle of the door is located. Whether this be in the individual's home or if the person is traveling and in a hotel, this problem is not resolved by current devices.

The problem, generally stated, is locating the handle of a door. The senses available to a person for locating a door are typically the visual senses and the auditory senses.

U.S. Pat. No. 5,581,230 discloses a lighted door handle which is comprised of a system which is built into the door handle and contains a complicated assembly for latching and unlatching a door and a complex power supply system. This invention, however, requires that the light and other mechanism of the invention be an integral part of the handle assembly. This invention is expensive and cumbersome and is only applicable to certain types of doors.

SUMMARY OF THE INVENTION

The present invention consists of a mounting member such as a rectangular plate with a means for attaching that mounting member to a door in close proximity to the handle on the door and a light emitting device which is located in such a manner as to cast illumination upon the door handle. The placement of the light emitting display upon this mounting member eliminates the problems as seen in the prior art devices of the difficult assembly and special door handle requirements and further allows for the accommodation of various means of attracting an individual's attention to the location of the door handle. When using a timekeeping device as the light emitting display, additional benefits are derived. These benefits include attracting the individual's attention to the exact location at a specific time of day.

BRIEF DESCRIPTION OF THE DRAWINGS

A better understanding of the present invention will be had upon reference to the following detailed description when read in conjunction with the accompanying drawings in which.

DETAILED DESCRIPTION OF A PREFERRED EMBODIMENT OF THE PRESENT INVENTION

The present invention will be described in conjunction with the drawings.

It will be understood, however, that the present invention will have applications in other areas of goods and that the description of the present invention with respect to the preferred embodiment is by way of example only.

Figure 1:
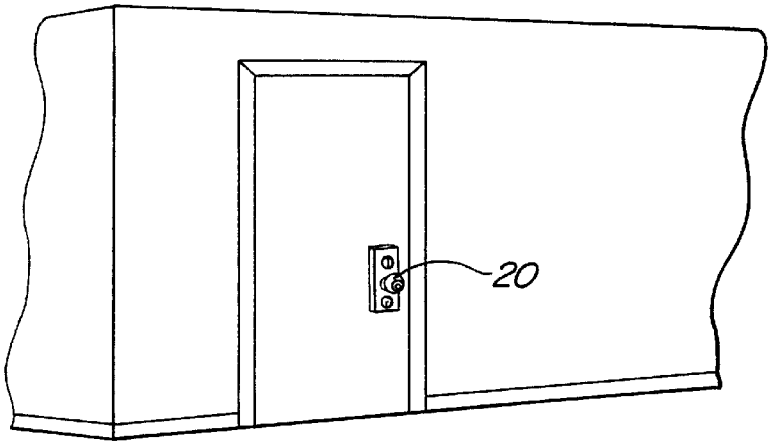
FIG. 1 is a front elevational view of a preferred embodiment of the invention.
Figure 2:
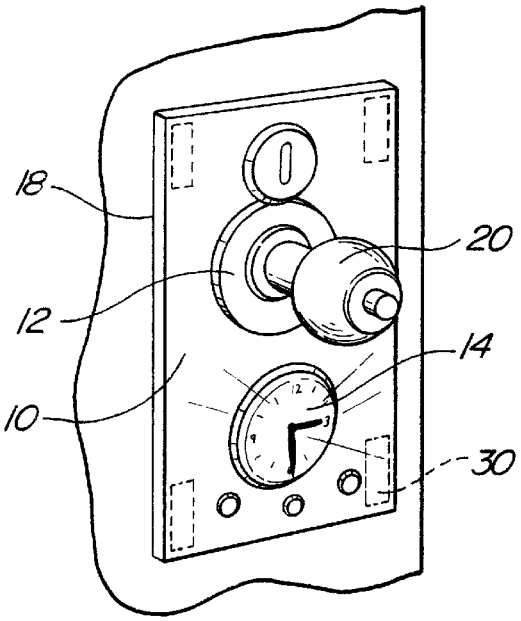
FIG. 2 is an enlarged partial front view of the preferred embodiment illustrated in FIG. 1.

With reference now to FIGS. 1 and 2, the mounting member 10 is a rectangularly shaped piece of material (plastic, metal or other suitable material) which is sufficiently large to contain an opening 12 which is large enough to allow a door handle to be inserted through the opening. The light emitting device 14 in this embodiment consists of a timekeeping instrument which contains solar panels 16 which charge the batteries contained within the light emitting device (the timepiece). The mounting member 10 may also be constructed of a material which is translucent, thereby allowing the light emitting device 14 to be mounted either inside the mounting member 10 or on the rear face 18 of the mounting member. The primary requirement for the light emitting device 14 is that it be placed in proximity to the door handle 20 in order that the door handle 20 be illuminated by the light emitting device 14.

Figure 4:
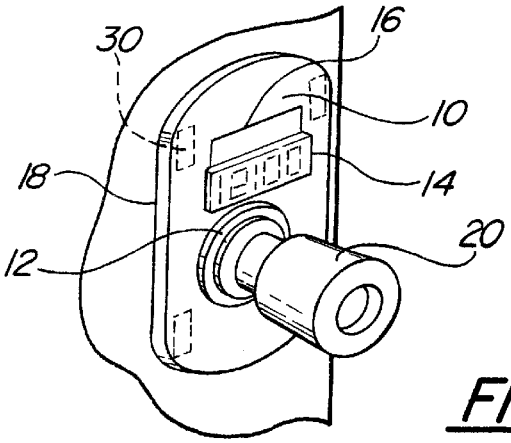
FIG. 4 is a view similar to FIGS. 2 and 3 but illustrating yet another preferred embodiment of the present invention.

With reference to FIGS. 2 and 4, the attachment means 30 in this embodiment consists of a set of four pressure sensitive adhesive strips which contain adhesive on each side which are functional to locate the light emitting device in proximity to the door handle. In some of the preferred embodiments, the use of the adhesive strips may be limited to less than the four strips of the preferred embodiment and in other embodiments the adhesive may be of permanent or semi-permanent quality.

Figure 3:
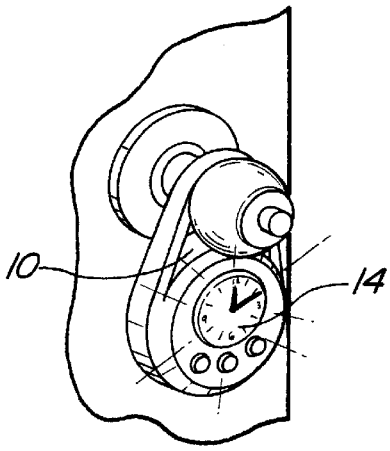
FIG. 3 is a view similar to FIG. 2 but illustrating another preferred embodiment of the present invention.

With reference to FIG. 3, another embodiment of the invention is shown in which the mounting member is placed in proximity to the door handle by a hook which is formed into the mounting member.

Yet another embodiment is shown in FIG. 4 with the purpose of providing a travel version of the invention. It is foreseen that the adhesive strips which may be used will be of a type which are easily removable. Another embodiment of this travel version would not employ the use of adhesive strips at all. In yet another implementation of this travel embodiment, the mounting member would contain an attaching means which will accommodate any type of door handle mechanism. This attaching means may be a hook which is formed into the mounting member or an attaching means which is comprised of a string or other flexible type of attaching means so long as it is capable of placing the light emitting device within close proximity to the door handle.

It should be clear to one skilled in the art that the light emitting device could be any device capable of illuminating the door handle, including, but not limited to, an illuminated standard watch face or a liquid crystal display, and further including a variety of power sources such as solar panels, batteries and the like.

Unlike the previously known methods for illuminating the handle of a door, the present invention can provide the required functionality in a much more efficient and economical fashion than has been heretofore possible.

Having described our invention, however, many modifications thereto will become apparent to those of skill in the art to which it pertains without deviation from the spirit of the invention as defined by the scope of the appended claims.

I claim:

1. An illuminated article for a door handle, comprising:

a mounting member, said mounting member comprising a panel having a front face and a back face;

attaching means carried by said mounting member for attaching said mounting member to the door adjacent to said handle;

and a light emitting device carried by said mounting member, said light emitting device being viewable through the front face of said mounting member.

2. An illuminated article as described in claim 1, wherein:

said panel is formed with an opening sufficient to receive said handle of the door.

3. An illuminated article as described in claim 1, wherein:

said light emitting device is the illuminated face of a clock visible through the front face of the panel.

4. An illuminated article as described in claim 3, wherein:

said clock is a liquid crystal display including a solar panel for energy source.

5. An illuminated article as described in claim 1, wherein:

said attaching means comprises an adhesive layer.

6. An illuminated article as described in claim 5, wherein:

said adhesive layer is a pressure sensitive adhesive carried by at least one strip attached to said panel.

7. An illuminated article as described in claim 5, wherein:

said mounting member is a panel having a front face and a back face;

said attaching means comprising a plurality of double-sided adhesive strips attached to the back face of the panel.

8. An illuminated article as described in claim 7, wherein:

said panel is of rectangular configuration;

said plurality of adhesive strips are attached to the four corners of the panel.

9. An illuminated article for a door having a handle, comprising:

a mounting member, said mounting member having a front face and a back face;

attaching means for attaching said mounting member to said door handle; and a light emitting device carried by said mounting member said light emitting device comprising a clock.

10. An illuminated for a door having a handle, comprising:

a mounting member, said mounting member having a front face and a back face;

attaching means for attaching said mounting member to a door; and a light emitting device carried within said mounting member, said light emitting device being substantially coplanar with said front face of said mounting member.

* * * * *